US006896059B2

(12) United States Patent
Brooks et al.

(10) Patent No.: US 6,896,059 B2
(45) Date of Patent: May 24, 2005

(54) COMPONENTS AND METHODS FOR USE WITH EXPLOSIVES

(75) Inventors: James E. Brooks, Manvel, TX (US); Wenbo Yang, Sugar Land, TX (US); Brenden M. Grove, Missouri City, TX (US); Ian C. Walton, Sugar Land, TX (US); Lawrence A. Behrmann, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 10/382,812

(22) Filed: Mar. 6, 2003

(65) Prior Publication Data

US 2003/0150646 A1 Aug. 14, 2003

Related U.S. Application Data

(62) Division of application No. 09/620,980, filed on Jul. 21, 2000, now Pat. No. 6,554,081.

(60) Provisional application No. 60/196,351, filed on Apr. 12, 2000, and provisional application No. 60/145,033, filed on Jul. 22, 1999.

(51) Int. Cl.[7] ..... E21B 43/117

(52) U.S. Cl. ..... 166/297; 166/55.1; 175/4.54; 102/312

(58) Field of Search ..... 175/4.54; 102/312, 102/313, 314; 166/297, 55.1

(56) References Cited

U.S. PATENT DOCUMENTS 2,029,454 A * 2/1936 Wells ..... 175/4.54
2,029,478 A * 2/1936 Haines ..... 175/4.54
2,139,104 A * 12/1938 Wells ..... 175/4.54
2,446,640 A * 8/1948 Davis ..... 175/4.54
2,609,750 A * 9/1952 McFarland ..... 102/312
3,163,112 A * 12/1964 Rhea ..... 102/310
3,329,218 A 7/1967 Bell
3,654,866 A * 4/1972 Fritz ..... 102/312
3,707,914 A * 1/1973 Land ..... 102/301
4,326,462 A * 4/1982 Garcia et al. ..... 102/310
4,428,440 A 1/1984 McPhee
4,753,301 A * 6/1988 Berry ..... 175/4.6
5,088,557 A * 2/1992 Ricles et al. ..... 166/297
5,131,470 A * 7/1992 Miszewski et al. ..... 166/297
5,505,261 A * 4/1996 Huber et al. ..... 166/297
5,810,098 A * 9/1998 Wathen ..... 175/4.58
5,837,925 A 11/1998 Nice
5,881,826 A * 3/1999 Brookey ..... 175/72
5,977,030 A * 11/1999 House ..... 507/110
6,123,159 A * 9/2000 Brookey et al. ..... 175/72
6,148,917 A * 11/2000 Brookey et al. ..... 166/301
6,156,708 A * 12/2000 Brookey et al. ..... 507/102
6,390,208 B1 * 5/2002 Brookey ..... 175/72

* cited by examiner

*Primary Examiner*—Hoang Dang
(74) *Attorney, Agent, or Firm*—Trop, Pruner & Hu PC; Jaime A. Castano; Brigitte Echols

(57) ABSTRACT

An apparatus and method is provided to reduce interference resulting from activation of explosive devices. To reduce interference, one or more shock impeding elements are placed proximal one or more explosives to impede propagation of shock caused by detonation of the explosives. The shock impeding elements include a porous material, such as a porous liquid or solid.

50 Claims, 16 Drawing Sheets

COMPONENTS AND METHODS FOR USE WITH EXPLOSIVES

This is a divisional of U.S. Ser. No. 09/620,980, filed Jul. 21, 2000 now U.S. Pat. No. 6,554,081, which claims the benefit under 35 U.S.C. § 119(e) to U.S. Provisional Application Ser. No. 60/196,351, entitled "Shock Protection for Explosives," filed Apr. 12, 2000; and to U.S. Provisional Application Ser. No. 60/145,033, entitled "Shock-Protection Barriers for Shaped Charges," filed Jul. 22, 1999.

BACKGROUND

The invention relates to components and methods for use with explosives, such as shaped charges and other types of explosives used in wellbore applications.

To complete a well, one or more formation zones adjacent a wellbore are perforated to allow fluid from the formation zones to flow into the well for production to the surface or to allow injection fluids to be applied into the formation zones. A perforating gun string may be lowered into the well and one or more guns fired to create openings in casing and to extend perforations into the surrounding formation.

A perforating gun typically includes a gun carrier on which multiple shaped charges are mounted. One type of shaped charge is the capsule shaped charge, which is sealed by a capsule to protect explosive material from corrosive fluids and elevated temperatures and pressures in the wellbore. Other types of shaped charges include non-capsule charges that are carried in sealed containers or hollow carriers.

Referring to FIG. 1, a generally conical shaped charge 10 includes an outer case 12 that acts as a containment vessel designed to hold the detonation force of the detonating explosion long enough for a perforating jet to form. Common materials for the outer case 12 include steel or some other metal. With a capsule charge, the outer case 12 may be part of the capsule housing, and a cap (not shown) is attached to the front of the case 12 to keep the explosive 16 and generally conical liner 20 sealed from the wellbore environment. A non-capsule charge may be arranged as illustrated in FIG. 1, with the liner 20 exposed.

The main explosive charge 16 is contained inside the outer case 12 and is sandwiched between the inner wall of the outer case 12 and the outer surface of the liner 20. A primer column 14 is a sensitive area that provides the detonating link between a detonating cord 15 (attached to the rear of the shaped charge) and the main explosive charge 16. A detonation wave traveling through the detonating cord 15 initiates the primer column 14 when the detonation wave passes by, which in turn initiates detonation of the main explosive charge 16 to create a detonation wave that sweeps through the shaped charge 10. The liner 20 collapses under the detonation force of the main explosive charge 16. Material from the collapsed liner 20 forms a perforating jet that shoots through the front of the shaped charge 10, as indicated by the arrow 22.

The diameter and depth of a perforation tunnel created in a well formation is determined by the speed and geometry of the perforating jet as it enters the formation. The symmetry and stability of the perforating jet, which are important to promote a long straight perforation tunnel, may be adversely affected by shock waves generated by detonation of neighboring charges. As a perforating jet enters the surrounding wellbore liquid, the jet creates a cavity inside the liquid. The shock waves from the charge itself and from surrounding charges can collapse the cavity so that the liquid can interfere with the jet.

To reduce charge-to-charge interference, some predetermined separation is needed between shaped charges in a perforating gun. In conventional systems, perforator performance decreases with increasing shot density (above some critical value of shot density) and with increasing gun-to-casing clearance (the amount of water or other liquid the perforating jet has to traverse). The performance decrease is typically greater for perforating systems with capsule charges because of the direct coupling of the exploding charge case to the wellbore fluid. The cause of the performance degradation may be due to the interaction between explosive induced shock in the wellbore fluid and either the perforating jet or the perforator itself during formation of the jet.

Another issue associated with perforating and other types of explosive systems is the potential for damage to downhole equipment. For example, the perforating gun itself, the casing, and other components may be damaged by the shock induced by an explosion.

Another type of interference is "pre-shock" interference, in which the detonation wave traveling through a detonating cord (e.g., the detonating cord 15 in FIG. 1) interferes with the performance of the shaped charge. The strand of detonating cord 15 may be attached to a plurality of shaped charges that are mounted on the gun carrier. For a single-directional perforating gun, such as a 0°-phased perforating gun, the strand of detonating cord 15 extends generally along a straight line. The shaped charges may also be mounted in a phased arrangement, such as a spiral arrangement or some other phasing pattern. With shaped charges arranged in a spiral arrangement, the detonating cord extends in a generally helical fashion. In some other phased arrangements, such as a ±45° twisted arrangement, the detonating cord 15 may be weaved in a fairly tortuous path across the rear surfaces of the charges. In all these arrangements, the detonating cord 15 traverses across substantial parts of the rear surfaces of the outer case 12 of the shaped charges 10.

As illustrated in FIG. 1, the detonating cord 15 makes contact with, or is in near proximity to, a substantial portion of the rear surface of the shaped charge 10. A detonating wave travels through the detonating cord 15 at high speed, typically about 6–8 km/s (kilometers per second). The detonation wave transfers energy to the primer column 14 to detonate the shaped charge 10. However, the detonation wave also transfers a high pressure shock, referred to as pre-shock, to the portion of the outer case 12 in contact with or in close proximity to the detonating cord. The pre-shock may also be transferred from the detonating cord to the outer case 12 through a liquid (such as water in the wellbore). Since the outer case 12 is typically made of a metal such as steel, which is a material having high shock transmissibility, the shock transferred to the explosive 16 may be significant.

Thus, an instance in time before the initiation energy of the detonating cord 15 reaches the primer column 14, a pre-shock may have been applied through the outer case 12, which is communicated into the explosive 16. The propagation of the pre-shock wave through the outer case 12 and the explosive 16 may interfere with the initiation front from the primer column 14 into the explosive 16. This may cause an asymmetry in the resultant collapse of the shaped charge liner 20. Possible adverse effects of such pre-shock interference may include one or more of the following: the perforating jet may have a crooked (rather than a straight) tip, and the cross-section of the jet may be elliptical rather than generally circular. Such adverse effects may reduce the penetration depth of a perforating jet produced by the shaped charge.

In some more severe situations, particularly with insensitive explosives having relatively slow detonation speeds, a mis-fire may occur due to the pre-shock wave reaching the explosive 16 through the outer case 12 before the main initiation front through the primer column 14. In this case the pre-shock wave densifies the explosive 16 before the main initiation front reaches the explosive 16, which may cause the mis-fire.

Some conventional methods of reducing unwanted pre-shock may include the following. A separation gap may be provided between the detonating cord and the outer case. Another solution is to provide a longer primer column 14. The thickness of the outer case 12 may also be increased to increase the length of the path that the pre-shock wave has to traverse before encountering the explosive 16 of the shaped charge. Another solution involves reducing the amount of explosive in the detonating cord to reduce the pre-shock level. Another technique is to use a detonating cord with conventional plastic jackets of standard thicknesses instead of metal jackets. Although such solutions reduce the effects of shock to some degree, they may not be adequate in some cases. For example, if the shaped charges are shot in liquid, which is usually the case in a wellbore, the pre-shock effect is accentuated since the coupling of shock between the detonating cord and the shaped charge is stronger. The shock coupling is stronger in liquid due to inertial confinement and the mass of the liquid.

A further issue associated with the use of explosives in a downhole environment is the structural integrity of the gun and attached explosives. Explosives such as shaped charges are contained or attached to gun carriers for conveying into a wellbore. The gun carriers may include strips, brackets, and the like, for carrying capsule shaped charges. Since the capsule charges are typically exposed, damage to the gun may occur when the shaped charges collide with other downhole structures as the gun is run downhole. Providing a hollow carrier may provide protection for the shaped charges and carrier of the gun, but the hollow carrier increases the outer diameter of the gun and may reduce gun performance, as measured by perforation penetration depth or the diameter of the perforation.

A need thus continues to exist for improved methods and apparatus to overcome limitations of conventional tools that contain explosives.

SUMMARY

In general, according to one embodiment, an explosive device for use in a wellbore environment comprises plural explosives and one or more shock impeding elements proximal the plural explosives to provide an impediment to shock wave propagation in the wellbore environment caused by detonation of the explosives.

Other features and embodiments will become apparent from the following description, from the drawings, and from the claims.

DETAILED DESCRIPTION

Figure 1:
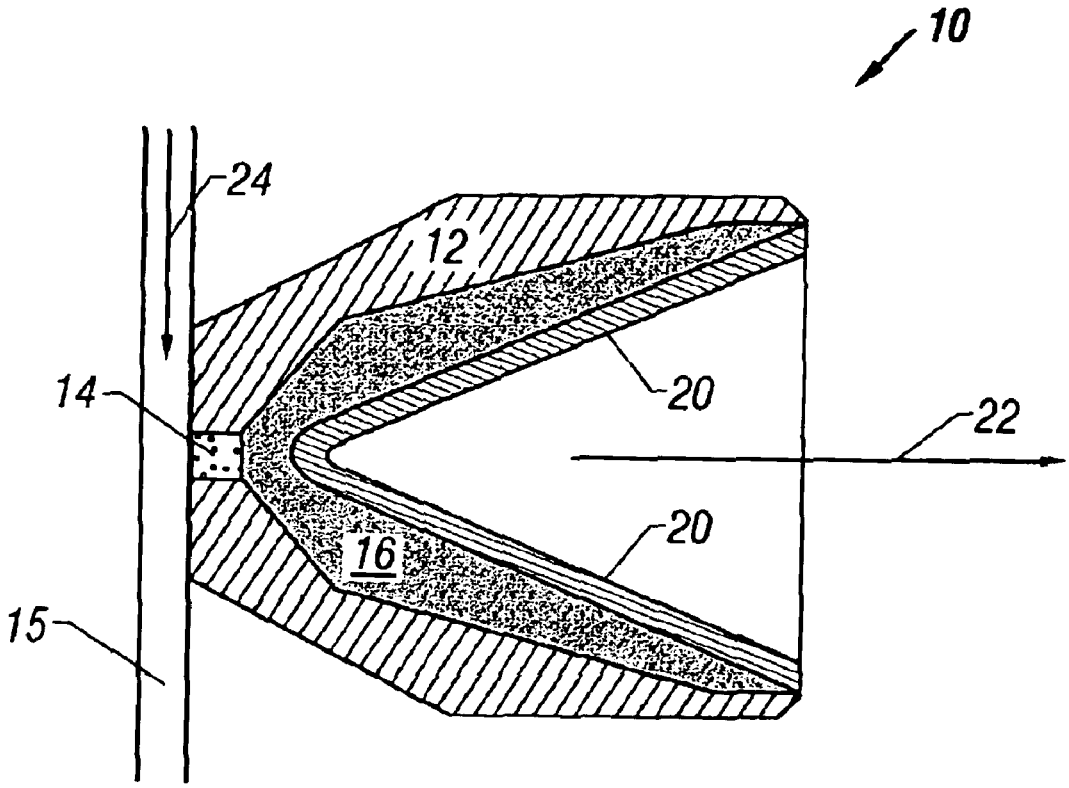
FIG. 1 (Prior Art)
FIG. 1 illustrates a conventional shaped charge.

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "below" and "above"; and other like terms indicating relative positions above or below a given point or element are used in this description to more clearly describe some embodiments of the invention. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

In accordance with some embodiments, shock impeding materials are used to reduce interference associated with the detonation of explosives such as shaped charges in perforating guns. Interference reduction is achieved by providing an impediment to shock wave propagation in the wellbore environment caused by detonation of the explosives. In further embodiments, shock impeding materials may be used in other types of tools containing explosives, such as cutters for tubing, casing, drillpipe, drill collar or the like. Explosives may also be used in actuators, setting devices, and other downhole devices.

Typically, a perforating gun is fired in wellbore liquids (such as water), which enhances interference and shock effects that reduce performance of shaped charges. Shock and interference effects include one perforating jet interfering with another jet, the shock from explosion in a charge affecting a perforating jet, the shock from explosion in a charge affecting jet formation in another charge, the shock from initiation of a detonating cord affecting jet formation in a charge, and the shock from initiation of a detonating cord interfering with a perforating jet.

To reduce shock and interference effects, a shock impeding material placed in the proximity of the explosives, such as shaped charges, may be employed in some embodiments. As used here, a "shock impeding" material refers to any material (solid, gas, liquid) that absorbs, dampens, attenuates, blocks, reduces, dissipates, eliminates, redirects, reflects, diverts, delays, isolates, impedes, or otherwise decreases effects of the shock produced by one explosive on any surrounding structure, including another explosive or another component. In some embodiments, the shock impediment is accomplished by converting kinetic energy into thermal energy or other internal energy (e.g., phase transition energy).

Examples of shock impeding materials include porous materials such as porous solids or liquids. A porous material is any material filled in part with compressible elements or a compressible volume (e.g., vacuum, gas, or other material). As used here, a "compressible volume" can be any volume that is filled with a compressible material or a vacuum. The shock impeding characteristic of a porous material is related to its strength, density, and porosity. To achieve desirable shock impeding characteristics, a material should be high density and should have a significant volume of (e.g., about 2%–90%) of highly compressible material (gas, vacuum, solid, liquid) dispersed throughout the shock impeding material. In one arrangement, the compressible material can be dispersed uniformly throughout the shock impeding material.

Porous liquids include aerated liquids, which are liquids in which a gaseous phase co-exists with a liquid phase. Porous liquids may also be aphron-based liquids or liquids containing hollow spheres or other shells that are filled with gas or vacuum. Alternatively, the porous material may also be a solid, such as cement mixed with hollow microspheres (e.g., LITECRETE™ from Schlumberger Technology Corporation) or other hollow spheres or shells, epoxy mixed with hollow spheres or shells, a honeycomb material, and any other solid filled with a certain percentage of compressible volume. For porous materials, adequate shock impeding characteristics may be exhibited by materials having a porosity greater than about 2%. Other example porosity ranges include porosities of greater than about 5%, 10%, 20%, 30%, up to about 90%. In further embodiments, instead of compressible volumes to fill pores of a porous solid, a material that exhibits a phase change (referred to as a "phase change" material) may be used. Examples of phase change materials include bismuth and graphite.

The porous material acts as a shock impeding element with a slower sound speed relative to typical wellbore liquids. The shock impeding element protects other explosives from shock waves generated by detonation of an explosive. Thus, with reduced interference and shock effects, performance of explosives, even at high shot densities and large gun-to-casing clearances, may be improved. Another benefit of using a shock impeding element is that damage to downhole equipment may be reduced. For example, enough shock energy may be absorbed by the shock impeding element such that shock waves may be attenuated and delayed to cause less damage to perforating equipment, casing, and other equipment. With the magnitude of shock waves reduced, the likelihood of microannulus formation (casing/cement microannulus, cement/formation microannulus) may be reduced.

In accordance with other embodiments of the invention, a shock barrier is provided to reduce the amount of shock (referred to as "pre-shock") transferred from a detonating cord to an explosive, such as an explosive in a shaped charge (which may be either a capsule charge or a non-capsule charge). Such a shock barrier may be formed of any material having reduced shock wave transmissibility to provide shock isolation, absorption, attenuation, dampening, blocking, impeding, reduction, dissipation, elimination, redirection, diversion, reflection, and/or to provide a sufficient time delay to allow the jet to form symmetrically. Such materials may include plastic, rubber, ceramics, powdered metal or other material, bismuth, a porous material (such as one of the materials described above), lead, wood, foamed metal, syntactic foam, an ashy substance, or other materials having low shock transmissibility (that is, materials that provide for shock isolation, absorption, attenuation, dampening, blocking, impeding, reduction, dissipation, elimination, redirection, diversion, reflection, and/or delay in the transfer of the shock).

Figure 2:
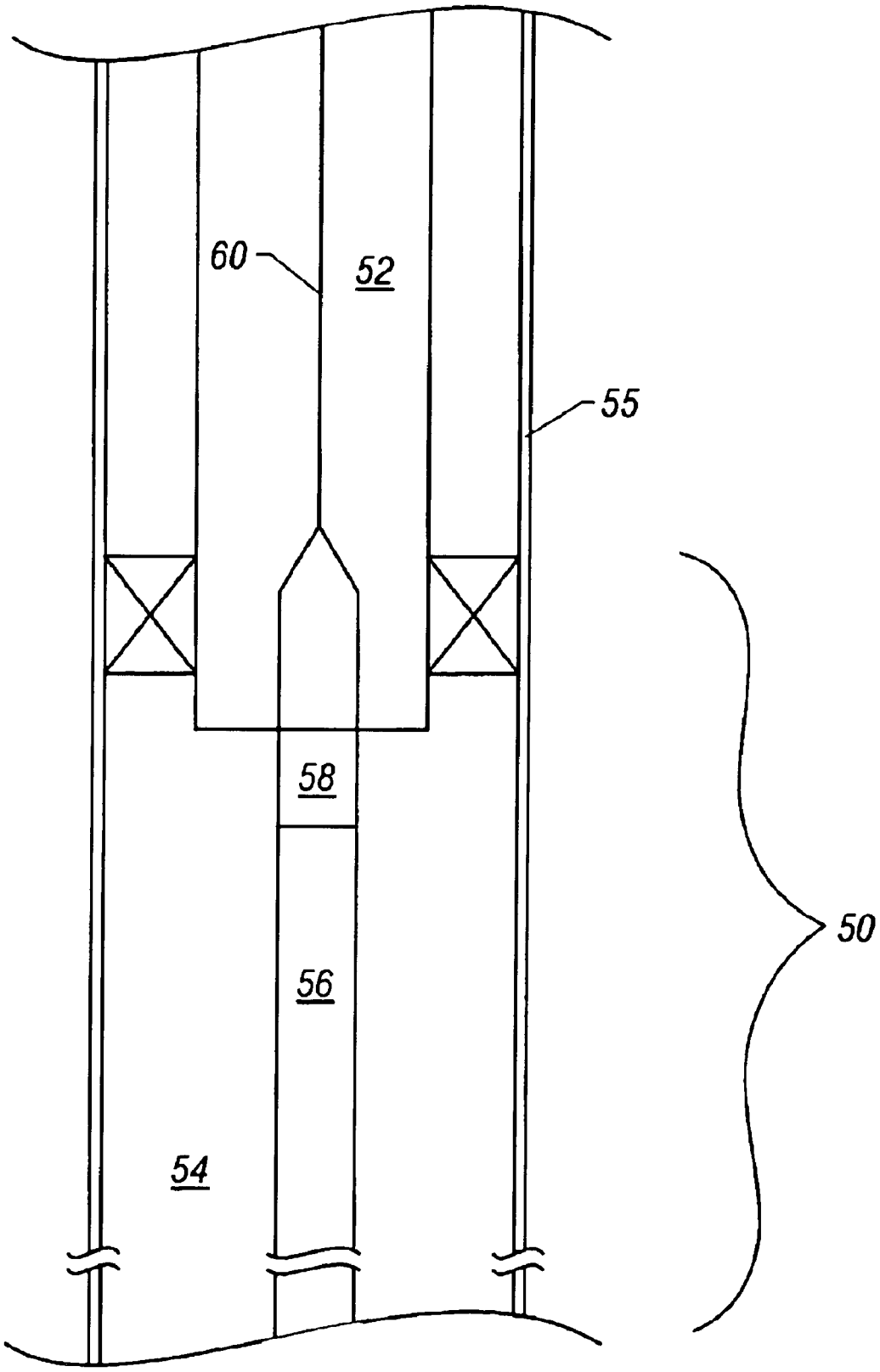
FIG. 2 illustrates an embodiment of a gun string positioned in a wellbore and including a gun system according to one of several embodiments.

Referring to FIG. 2, a perforating gun string 50 is positioned in a wellbore. The perforating gun string 50 is designed to pass through a tubing 52 that is positioned in a wellbore 54 lined with casing 55. The perforating gun string 50 includes a perforating gun system 56 in accordance with various embodiments. The perforating gun system 56 may be attached to an adapter 58 that is in turn connected to a carrier line 60 for carrying the perforating gun string 50 into the wellbore 54. The carrier line 60 may include a wireline, a slickline, or coiled tubing, as examples. The several embodiments of the gun system 56 are described below. Each of the guns is protected by a shock impeding material. Even though the illustrated guns include shaped charges mounted in a phased manner, such phasing is not necessary for the shock impeding material to be effective. In fact, the shock impeding material is effective for any type of arrangement of shaped charges.

Figure 3A:
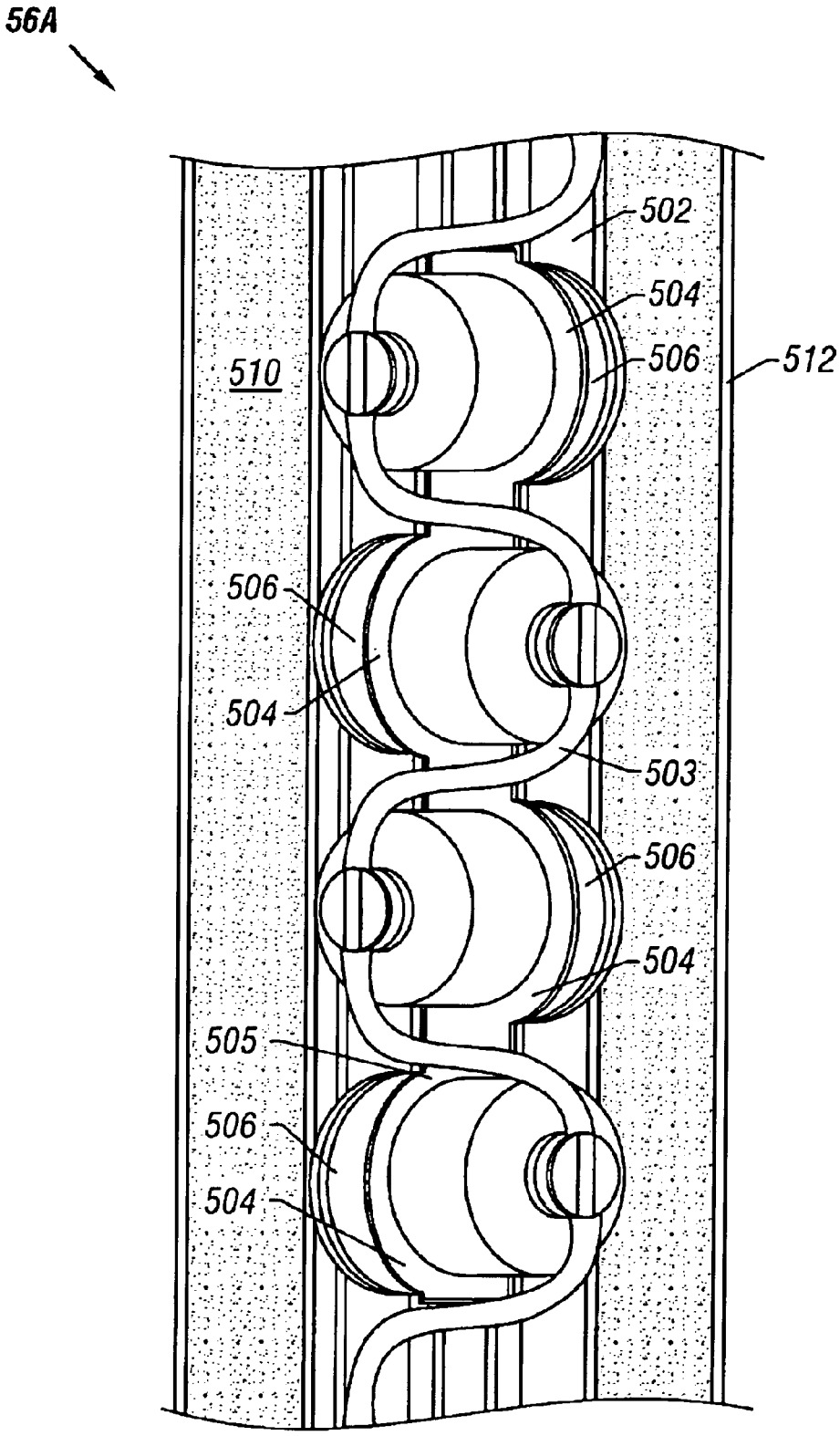
FIGS. 3A–3B illustrate a perforating gun system including an encapsulant formed of a porous material to encapsulate shaped charges attached to a support bracket and mounted on a linear strip, in accordance with an embodiment.
Figure 3B:
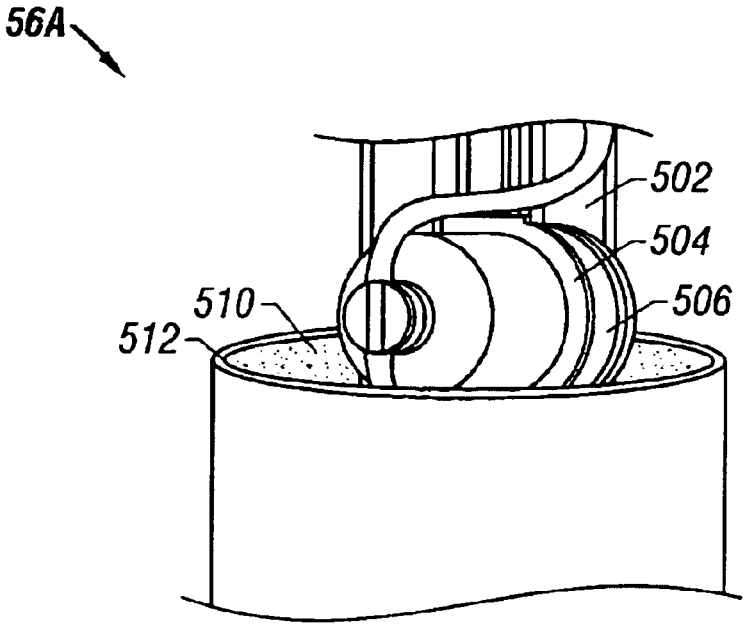

Referring to FIGS. 3A–3B, a perforating gun system 56A in accordance with one embodiment includes a linear strip 502 to which plural capsule shaped charges 506 are coupled. A detonating cord 503 is connected to each of the shaped charges 506. The shaped charges 506 are mounted in corresponding support rings 504 of a support bracket 505. The support bracket 505 may be twisted to provide a desired phasing (e.g., 45° spiral, 60° spiral, tri-phase, etc.). Alternatively, the support bracket 505 may be arranged in a non-phased pattern (e.g., 0° phasing). In another arrangement, the linear strip 502 may be omitted, with the support bracket 505 providing the primary support for the capsule charges 506.

In one embodiment, the carrier strip 502, support bracket 505, support rings 504, detonating cord 503 and capsule charges 506 are encapsulated in a shock impeding material 510. One example of the shock impeding material includes a porous solid such as porous cement. An example of a porous cement includes LITECRETE™. Porous cement is formed by mixing the cement with hollow structures, such as microspheres filled with a gas (e.g., air) or other types of gas- or vacuum-filled spheres or shells. Microspheres are generally thin-walled glass shells with a relatively large portion being air.

To provide structural support for the encapsulant 510, a sleeve 512 is provided around the encapsulant 510. The sleeve 512 is formed of any type of material that is able to provide structural support, such as plastic, metal, elastomer, and so forth. The sleeve 512 is also designed to protect the encapsulant 510 as the gun system 56A is run into the wellbore and it collides with other downhole structures. Alternatively, instead of a separate sleeve, a coating may be added to the outer surface of the encapsulant 510. The coating adheres to the encapsulant as it is being applied. The coating may be formed of a material selected to reduce fluid penetration. The material may also have a low friction.

In further embodiments, to provide higher pressure ratings, the encapsulant 510 may be formed using another type of material. For example, higher-pressure rated cement with S60 microspheres made by 3M Corporation may be used. As an alternative, the encapsulant 510 may be an epoxy (e.g., polyurethane) mixed with microspheres or other types of gas- or vacuum-filled spheres or shells. In yet a further embodiment, the encapsulant 510 can have plural layers. For example, one layer can be formed of porous cement, while another layer can be formed of porous epoxy or other porous solid. Alternatively, the encapsulant 510 can be a liquid or gel-based material, with the sleeve 512 providing a sealed container for the encapsulant 510.

In some embodiments, the shock impeding material is a composite material, including a hollow filler material (for porosity), a heavy powder (for density), and a binder/matrix. The binder/matrix may be a liquid, solid, or gel. Examples of solid binder/matrix materials include polymer (e.g., castable thermoset such as epoxy, rubber, etc., or an injection/moldable thermoplastic), a chemically-bonded ceramic (e.g., a cement-based compound), a metal, or a highly compressible elastomer. A non-solid binder/matrix material includes a gel (which is more shock compressible than a solid) or a liquid. The hollow filler for the shock impeding material may be a fine powder, with each particle including an outer shell that surrounds a volume of gas or vacuum. In one example embodiment, the hollow filler can include up to about 60% by volume of the total compound volume, with each hollow filler particle including 70%–80% by volume air. The shell of the hollow filler is impermeable and of high strength to prevent collapse at typical wellbore pressures (on the order of about 10 kpsi in one example). An alternative to use of hollow fillers is to produce and maintain stable air bubbles directly within the matrix via mixing, surfactants, and the like.

In one example embodiment, the heavy filler powder can be up to 50% by volume of the total compound volume, with the powder being a metal such as copper, iron, tungsten, or any other high-density material. Alternatively, the heavy filler can be sand. In other embodiments, the heavy powder can be up to about 10%, 25% or 40% by volume of the total compound volume. The shape of the high-density powder particles is selected to produce the correct mix rheology to achieve a uniform (segregation-free) final compound.

Using sand as the heavy filler instead of metal provides one or more advantages. For example, sand is familiar to field personnel and thus is more easily manageable. In addition, by increasing the volume of sand, the volume of matrix/binder is decreased, which reduces the amount of debris made up of the matrix/binder after detonation.

In some examples, the bulk density of the shock absorbing material ranges from about 0.5 g/cc (grams per cubic centimeter) to about 10 g/cc, with a porosity of the compound ranging from between about 2% to 90%.

A lower density porous material (less than about 1 g/cc) may be effective if there is a substantial volume of the material (such as if the entire casing bore is filled with the material). A higher-density porous material (greater than about 1.2 g/cc) is used when the volume of the shock impeding material is limited (such as when it is restricted to the charge/gun envelope). Desirable results have been observed with either a cement- or epoxy-based compound in which the shock impeding material volume is restricted to the charge/gun envelope (such as in FIGS. 3A–3B) and the density of the shock impeding material is about 1.3 g/cc and its porosity is about 30%–33%.

Other example porous solids include a 10 g/cc, 40% porous material, such as tungsten powder mixed with hollow microspheres, 50% each by volume. Another example compound includes 53% by volume low-viscosity epoxy, 42% by volume hollow glass spheres, and 5% by volume copper powder. The compound density is about 1.3 g/cc and the porosity is about 33%. Another compound includes about 39% by volume water, 21% by volume Lehigh Class H cement, 40% by volume glass spheres, and trace additives to optimize rheology and cure rate. The density of this compound is about 1.3 g/cc and the porosity is about 30%.

To form the encapsulant 510, the porous material (in liquid or slurry form) maybe poured around the carrier strip 502 contained inside the sleeve 512. The porous material is then allowed to harden. With porous cement, cement in powder form may be mixed with water and other additives to form a cement slurry. During mixing of the cement, microspheres are added to the mixture. The mixture, still in slurry form, is then poured inside the sleeve 512 and allowed to harden. The equipment used for creating the desired mixture can be any conventional cement mixing equipment. Fibers (e.g., glass fibers, carbon fibers, etc.) can also be added to increase the strength of the encapsulant.

The encapsulant 510 can also be premolded. For example, the encapsulant can be divided into two sections, with appropriate contours molded into the inner surfaces of the two sections to receive a gun or one or more charges. The gun can then be placed between the two sections which are fastened together to provide the encapsulant 510 shown in FIG. 3B.

Another feature, independent of the energy absorbing aspect, of the encapsulant 510 is its ability to provide structural support for the capsule charges 506. In this other aspect, the gun system 56A is also a molded gun in which the encapsulant 510 provides sufficient structural support so that traditional metal supports may be eliminated or reduced. For example, one function of the linear strip 502 in many gun systems is to provide the primary support for capsule charges. The linear strip 502 is a rigid metal member. To mount capsule charges, such as charges 506 in FIGS.

3A–3B, in a predetermined phased pattern to the linear strip 502, various mounting mechanisms may be employed, such as mounting clips, screws, or an elongated bracket such as bracket 505 in FIGS. 3A–3B. In some cases, mounting mechanisms may not provide sufficient structural rigidity when holding the capsule charges to the strip 502. The encapsulant 510 adds to the structural integrity of the gun system 56A by holding the capsule charges 506 in a more rigid manner with respect to the strip 502.

A further issue with downhole perforating operations is the amount of debris present in the wellbore after perforating has been performed. To reduce such debris, retrievable gun systems are often used. Many such systems employ linear strips similar to strip 502, which is designed to stay intact even after firing of the shaped charges 506. However, the linear strip 502 adds to the overall weight of the gun system 56A, and after firing, the linear strip 502 may be warped to a shape that makes retrieval from a wellbore difficult. To address these concerns, another version of the gun system 56A, as shown in FIG. 3C, omits the linear strip 502, using the support bracket 505 and the encapsulant 510 as the primary support mechanism.

Figure 3C:
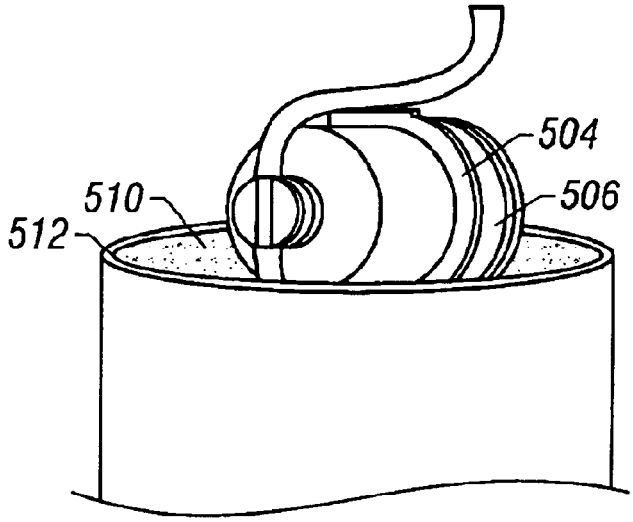
FIG. 3C illustrates a perforating gun system similar to the gun system of FIGS. 3A–3B with the linear strip omitted, in accordance with another embodiment.

The embodiments of FIGS. 3A–3C have the encapsulant 510 completely surrounding portions of the gun. In further embodiments, the encapsulant 510 can partially encapsulate, rather than fully encapsulate the charges 506, bracket 505, and strip 502 (if used).

Figure 4A:
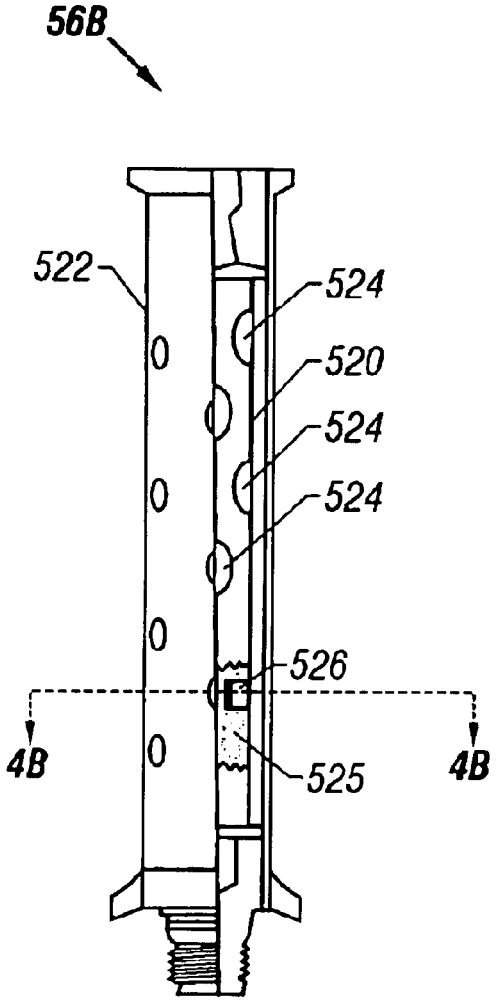
FIGS. 4A–4B illustrate a hollow carrier gun system in accordance with another embodiment that includes a loading tube in which shaped charges are mounted, with the loading tube filled with a porous material.
Figure 4B:
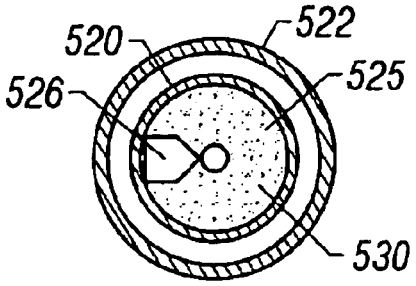

Referring to FIGS. 4A–4B, in accordance with another embodiment, instead of the carrier strip 502 shown in FIG. 3, a similar concept may be extended to a hollow carrier gun 56B. In the hollow carrier gun 56B, a loading tube 520 is positioned inside a hollow carrier 522. The loading tube 520 provides openings 524 through which shaped charges 526 may face. The shaped charges 526 may be non-capsule charges since the shaped charges are protected from the environment by the hollow carrier 522, which is typically sealed. After the shaped charges 526 are mounted inside the loading tube 520 during assembly, a porous material (e.g., porous cement) that is initially in liquid or slurry form may be poured through the top or bottom opening 530 of the loading tube. The material is then allowed to solidify to provide a porous material filler 525 inside the loading tube 520. The porous material filler 525 is an energy absorber that reduces charge-to-charge interference. FIG. 4B shows a cross-section of the gun 56B.

The porous material filler can also fill the inside of the hollow carrier 522 to provide a larger volume of the shock impeding material. Another benefit of the shock impeding material is that it may provide structural support for the hollow carrier so that a thinner-walled hollow carrier can be used. The shock impeding materials provide support inside the hollow carriers against forces generated due to wellbore pressures. With thinner hollow carriers, a lighter weight perforating gun is provided that makes handling and operation more convenient.

Figure 5:
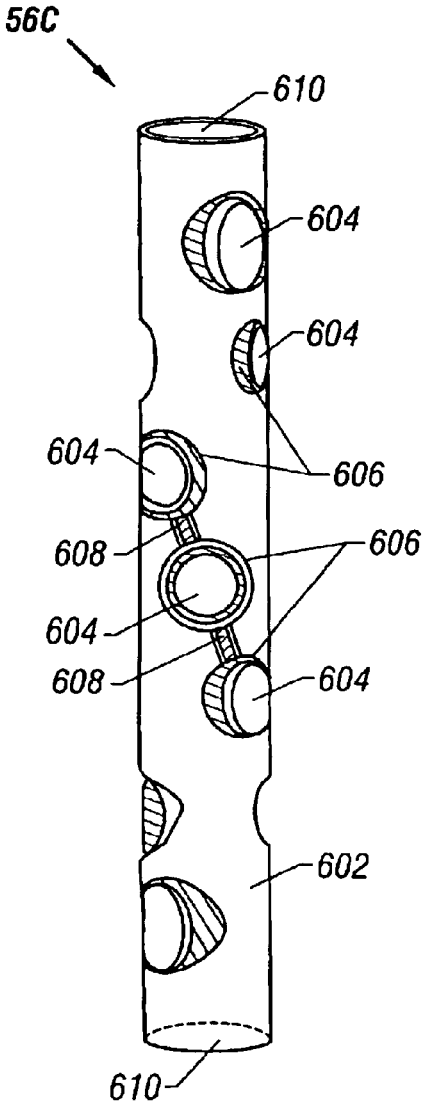
FIG. 5 illustrates a gun system in accordance with a further embodiment that includes a carrying tube containing shaped charges and a porous material.

Referring to FIG. 5, in accordance with yet another embodiment, a perforating gun system 56C includes a tubular carrier 602 that may be used to carry capsule charges 604 mounted proximal openings 606 in the tubular carrier 602. The tubular carrier 602 may be arranged in a manner similar to the loading tube 520 of the hollow carrier gun 56B, except that the tubular carrier 602 is not contained inside a hollow carrier. As a result, capsule charges 604 are used instead of the non-capsule charges 506 of FIG. 4A. In one arrangement, a detonating cord 608 may be run along the exterior of the tubular carrier 602 and connected to the capsule charges 606. In another arrangement, the detonating cord 608 may be run inside the tubular carrier 602. As with the loading tube 520 of FIG. 4A, a porous material (e.g., porous cement) that is originally in liquid or slurry form may be poured through a top or bottom opening 610 of the tubular carrier 602. The poured material solidifies inside the tubular carrier 602 to form the porous material for shock and interference reduction. An advantage of using the tubular carrier 602 is that damage to the porous material is less likely because it is protected by the tubular carrier 606, which is typically a sturdy and rigid structure.

Figure 6:
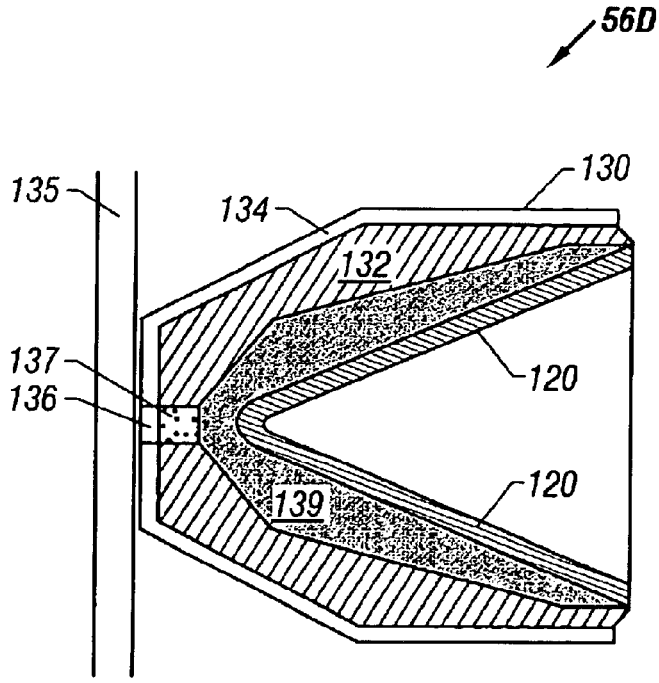
FIG. 6 illustrates a portion of a gun system having a shaped charge wrapped or coated by a shock impeding layer.

Referring to FIG. 6, in accordance with another embodiment, a gun system 56D includes a shaped charge 130 having an outer case 132 enclosed by an outer jacket, coating, or other layer 134, which is formed of an shock impeding material to reduce charge-to-charge interference. The shock-impeding outer jacket 134 can be formed of a material having low shock transmissibility, such as any of the materials discussed above. An opening 136 is provided in the outer sleeve 134 to allow transfer of energy from a detonating cord 135 to a primer column 137 that communicates the detonation energy from the detonating cord 135 to an explosive 139 inside the shaped charge 130. The explosive 139 may be lined by a liner 120.

The outer jacket, coating, or layer 134 provides an impediment to shock waves from neighboring shaped charges. In one embodiment, the shaped charge 130 may be dipped into a liquid material having low shock transmissibility to coat the shaped charges. The material may be initially in liquid form (e.g., when heated). In another embodiment, the outer jacket, coating, or layer 134 may be deposited onto the shaped charge 130. Alternatively, the layer 134 may be wrapped around the shaped charge 130.

Another benefit of the layer 134 is that transmission of pre-shock due to a detonation wave travelling through the detonating cord 135 to the shaped charge 130 is reduced. The layer 134 serves to isolate the back surface of the outer case 132 from the detonating cord 135. The pre-shock effect is discussed further below.

Figure 7:
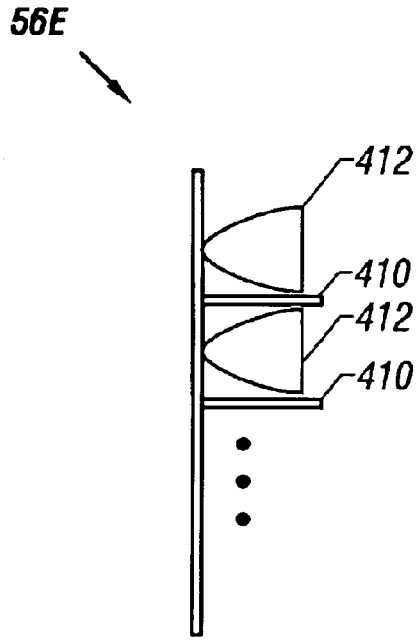
FIG. 7 illustrates a gun system according to yet a further embodiment including shock impeding barriers between shaped charges.

Referring to FIG. 7, in accordance with another embodiment, a gun system 56E includes shock impeding barriers 410 placed between shaped charges 412. The barriers 410 may be any type of material that can be used to impede transmission or propagation of shock waves. For example, the barriers 410 may be hollow metal tubes, e.g., steel tubes. Alternatively, the barriers 410 may be formed of other shock impeding materials, such as ones discussed above.

Figure 8A:
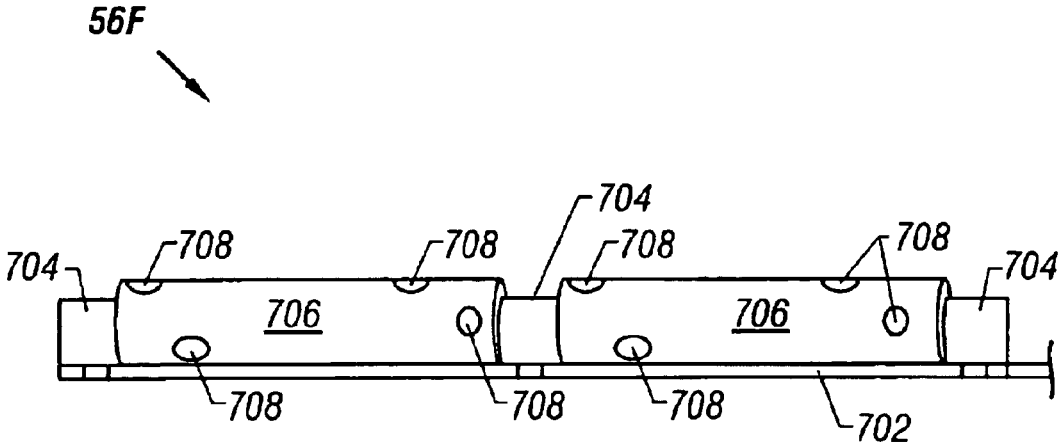
FIG. 8A illustrates a gun system according to yet another embodiment including a strip and shaped charges coupled to the strip and arranged in carrying tubes attached to the strip.

Referring to FIG. 8A, in accordance with yet another embodiment, a strip gun 56F includes plural shaped charges arranged in a phased pattern (e.g., spiral, tri-phased, and so forth) on a linear strip 702. Alternatively, a non-phased arrangement of the charges can be used. The 0°-phased shaped charges (referred to as 704) may be mounted directly to the strip 702. The other charges (not shown) are mounted inside tubes 706 attached to the strip 702. Openings 708 are provided in each tube 706 for corresponding shaped charges. A shock impeding material, which may be one of the porous materials discussed above, is provided in each tube 706 for charge-to-charge interference reduction.

Figure 8B:
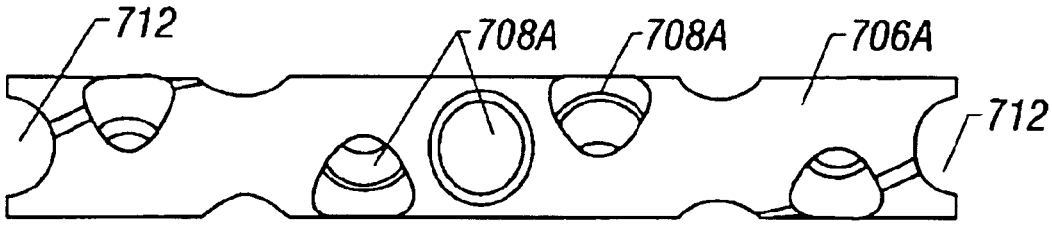
FIGS. 8B–8D illustrate a bar formed of a shock impeding material useable with the gun system of FIG. 8A, the bar having cavities and grooves to receive shaped charges and the detonating cord.
Figure 8C:
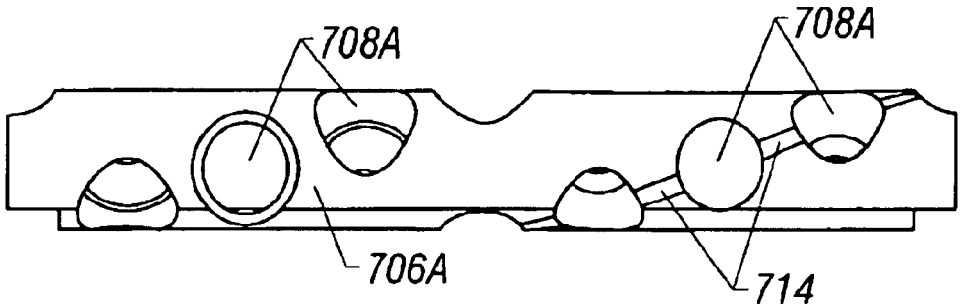
Figure 8D:
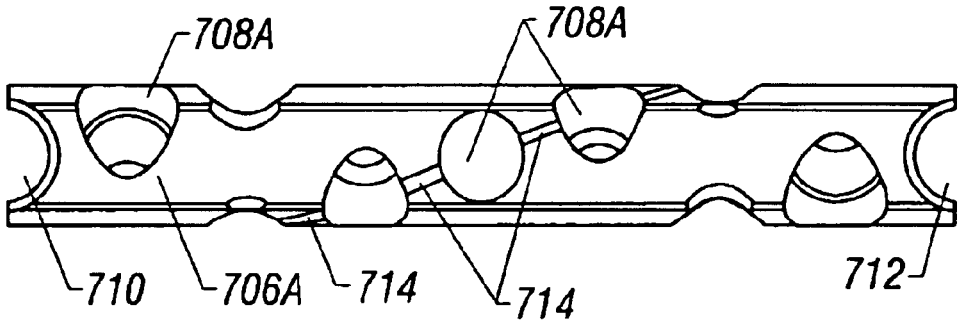
Figure 8G:
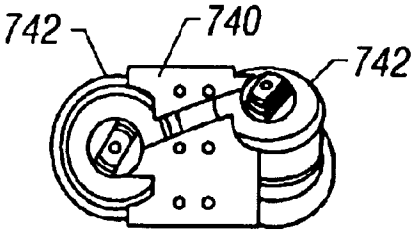
FIGS. 8G–8I illustrate a bracket connected to two capable charges in accordance with an embodiment.
Figure 8F:
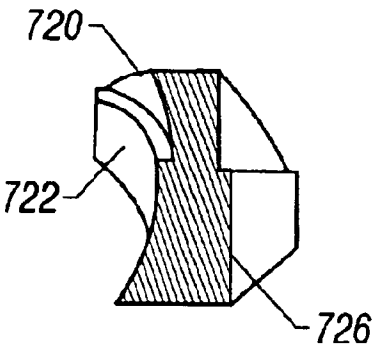
FIGS. 8E–8F illustrate a spacer formed at least in part of a shock impeding material.
Figure 8E:
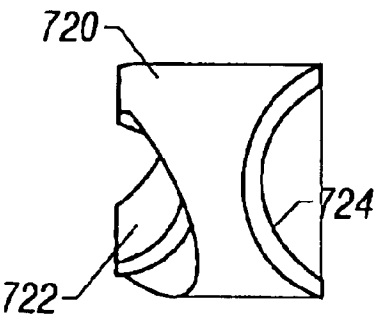

Referring to FIGS. 8E–8F, in accordance with an embodiment of the invention, a spacer 720 formed at least in part of a shock impeding material is positioned inside the tube 706 between successive charges. The spacer 720 has curved sides 722 and 724 to fit around corresponding shaped charges. The middle portion 726 between the two curved sides 722 and 724 is formed of the shock absorbing material to reduce the amount of interference between adjacent charges.

The tube 706 can be formed of a metal or other suitably rigid material. Alternatively, the tube 706 can also be formed of a shock impeding solid, such as a porous solid (e.g., porous cement, porous epoxy, etc.).

In FIGS. 8B–8D, in another embodiment, instead of a hollow tube 706, a solid bar 706A with cavities 708A (for the shaped charges) is used instead. FIGS. 8B–8D show three views of three different portions of the bar 706A without the charges mounted therein. The bar 706A can be made of a shock impeding material. As shown in FIGS. 8B and 8D, first and second grooves 710 and 712 are formed at the ends of the bar 706A to receive the 0°-phased shaped charges 704. Slots 714 are also formed on the outside surface of the bar 706A between the openings 708A to receive a detonating cord that is ballistically coupled to each of the shaped charges in the bar 706A.

Figure 8I:
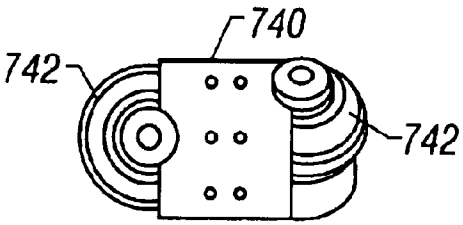
Figure 8H:
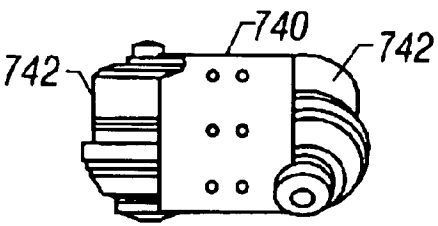

Referring to FIGS. 8G–8I, in accordance with another embodiment, a retainer 740 is designed to hold two adjacent capsule charges 742. The retainer 740 is generally tubular in shape and is designed to attach to the shaped charges 742. In one embodiment, the retainer 740 is designed to hold the pair of capsule charges 742 in an angularly offset manner. A spacer 720 (FIGS. 8E–8F) can be placed inside the retainer 740 between the capsule charges 702. After the capsule charges 742 have been attached to the retainer 740, the retainer 740 is attached to a carrier strip (not shown). Multiple sets of the retainer 740, capsule charges 742, and spacers 720 can be mounted onto the carrier strip to provide a perforating gun. Shock and interference effects are reduced by using the spacers 720 with the retainers 740.

Figure 9A:
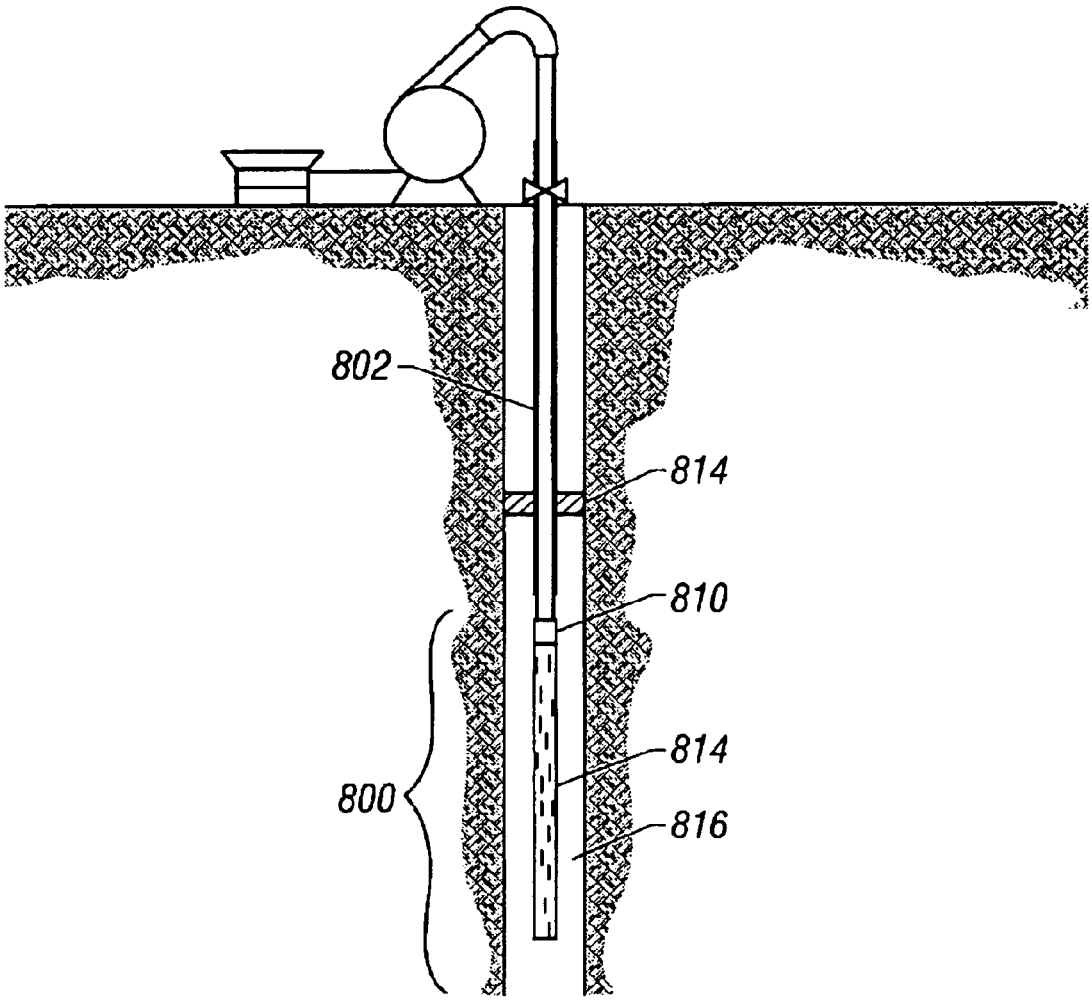
FIGS. 9A–9B illustrate a perforating string including a coiled tubing assembly for providing a porous liquid in a perforating interval in accordance with a further embodiment.

Referring to FIG. 9A, in accordance with another embodiment, a porous liquid (instead of a porous solid) is used to reduce interference. A perforating string 800 is carried by a coiled tubing assembly that also includes a coiled tubing 802, a packer 814, and a jetting sub 810. To reduce shock and interference effects, a porous liquid may be pumped through the inner bore of the coiled tubing 802 and through outlets of the jetting sub 810 to a region 816 around the perforating gun 814. The porous liquid may include bubble-filled liquids, aphron-based liquids, liquids filled with hollow shells containing gas or vacuum, and other porous liquids. Alternatively, the porous liquid can also be foam.

An aphron is made up of a core of an internal phase, usually liquid or gas, encapsulated in a thin aqueous shell. The shell contains surfactant molecules so positioned that they produce an effective barrier against coalescence with adjacent aphrons. The surfactant shell tends to orient at the gas-liquid interface to form a charged bubble surface that repels other bubbles to provide the resistance to coalescence.

Porous liquids provide a liquid that has a density close to that of liquid but a sound speed close to that of gas. By reducing the sound speed in the liquids in the region 816, the magnitude and speed of shock waves generated by detonation of shaped charges in the perforating gun 816 are reduced. A further benefit of the porous liquids is that they generally provide a larger volume of shock impeding material as compared to the porous solids discussed above. This enhances shock impediment to protect downhole structures such as the casing.

Figure 9B:
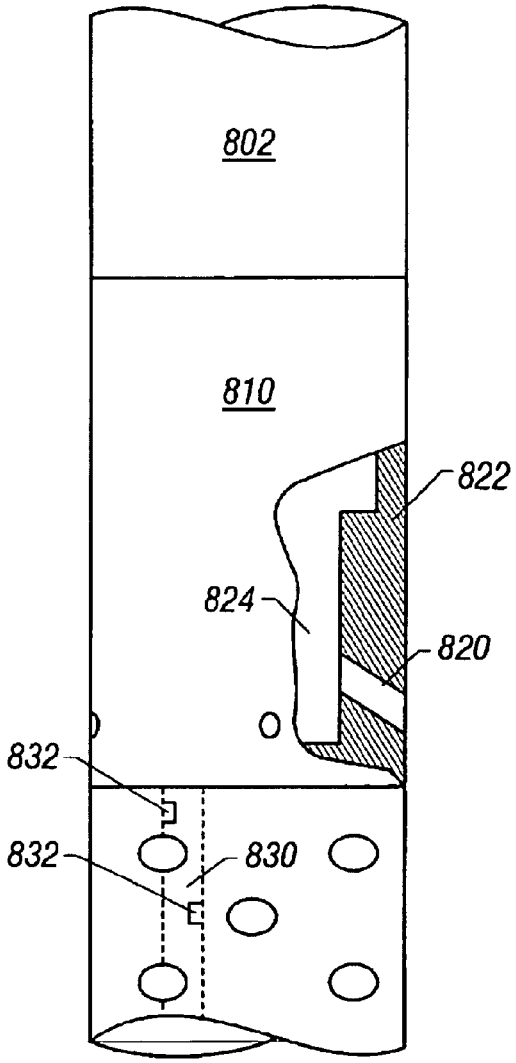

Referring to FIG. 9B, a portion of the coiled tubing assembly and the perforating gun string 800 is illustrated. The jetting sub 810 has a housing 822 that defines an inner longitudinal bore 824 in communication with the inner bore of the coiled tubing 802. One or more jetting ports 820 are defined in the housing 822 of the jetting sub 810 to enable communication between the inner longitudinal bore 824 and the outside of the perforating string 800. The position and size of the jetting ports 820 determine the desired jetting action of a fluid pumped through the coiled tubing 802, such as a porous liquid. In the illustrated embodiment, the jetting ports 820 are generally slanted downwardly to produce a jet of fluid that is directed downwardly. In other embodiments, the jetting ports 820 may be directed sideways or slanted upwardly or have other features such as nozzles or diffusers.

In operation, the coiled tubing assembly including the perforating gun string 800 is run into the wellbore. In one embodiment, the perforating gun string 800 is run to a position below the perforating interval, indicated generally as 816 (FIG. 9A). As further shown in FIG. 9C, a column of porous liquid 832 is pumped downwardly with a cap 830 that is formed of a gel, for example. The gel may be a polymer gel or another type of gel. The cap 830 can also be formed of another type of material, such as a solid (e.g., metal, polymer, etc.). The cap 830 traps the column of porous liquid 832 below the cap 830, with fluid pumped above the cap 830 to push the porous liquid 832 through the jetting ports 820 of the jetting sub 810. The porous liquid 832 is lighter than the wellbore liquids, so it has a tendency to rise. By positioning the perforating string and the jetting sub 810 below the perforating interval 816, the porous liquid is allowed to rise to fill up the perforating interval 816. After a sufficient amount of porous liquid is pumped into the wellbore, the coiled tubing assembly can be raised so that the perforating gun string 800 is positioned in the perforating interval 816, where it is surrounded by the porous liquid. The perforating gun 814 is then activated to extend perforations through the surrounding casing and into the formation.

In another arrangement as shown in FIG. 9A, a smaller diameter tubing 830 extending through the gun 814 can be connected to the coiled tubing. Plural outlets 832 are provided along the smaller diameter tubing. Such outlets 832 along the tubing are used in place of, or in addition to, the jetting ports 820 of the jetting sub 810. The porous liquid is delivered down the coiled tubing 802 and into the perforating interval through the plural outlets.

Figure 9C:
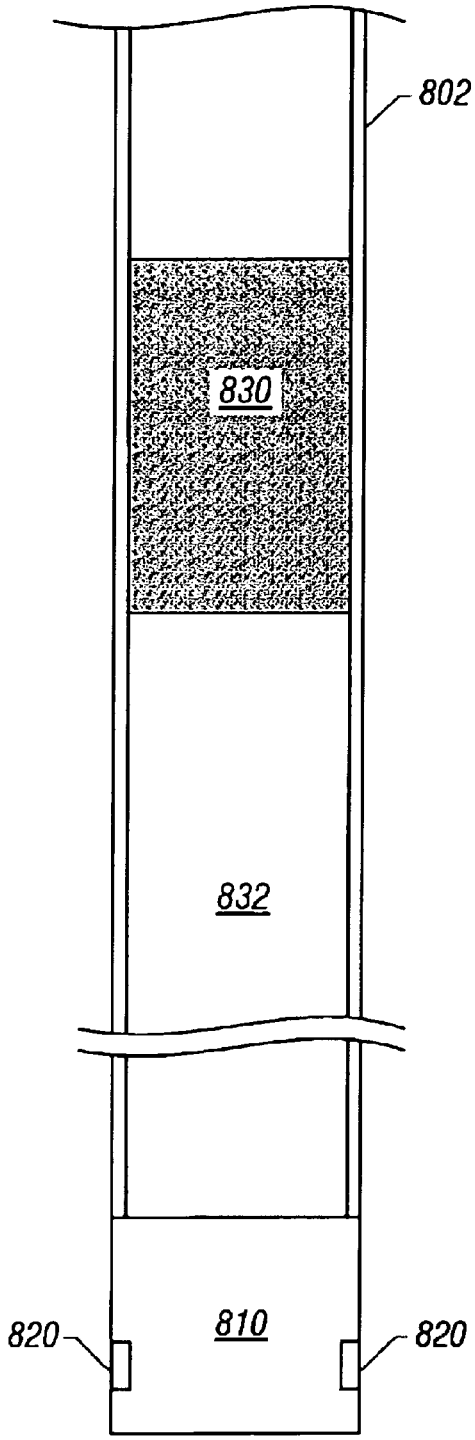
FIG. 9C illustrates the delivery of a porous liquid through the coiled tubing of FIGS. 9A–9B.
Figure 9D:
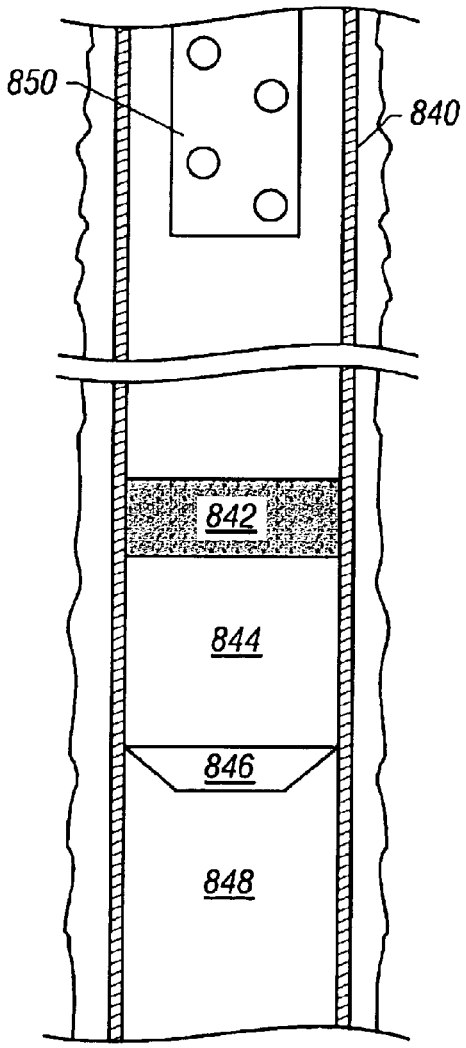
FIG. 9D illustrates the delivery of a porous liquid to a perforating interval as part of a cementing operation, in accordance with yet a further embodiment.

Referring to FIG. 9D, in accordance with another embodiment, a porous liquid, instead of being delivered through the coiled tubing assembly as shown in FIG. 9C, may be delivered during cementing operations. After casing (or a liner) has been installed in a wellbore, the casing or liner is cemented to the inner surface of the wellbore. This is accomplished by pumping cement, in slurry form, into the casing. When the cement reaches the bottom end of the casing, it starts filling the annulus region between the casing and the inner wall of the wellbore. Some time after the annulus between the casing or liner and the inner wall of the wellbore has filled up with cement slurry, the cement slurry hardens to cement the casing or liner to the wellbore.

As shown in FIG. 9D, a wiper plug 846 is launched into the wellbore above the cement slurry (848) to pump the cement slurry to the bottom of the casing or liner 840. In accordance with an embodiment of the invention, a column of porous liquid 844 may be introduced into the casing or liner bore above the cement wiper plug 46. A cap 842 can then be introduced above the porous liquid 844 column. The cap 842, porous liquid 844, plug 846, and cement 848 are then pumped into the casing or liner. After the cementing operation has completed, the cap 842 and the column of porous liquid 844 remain at the lower end of the casing or liner 840. The column of porous liquid 844 is of a sufficient volume so that it also fills up the desired perforating interval.

When perforating operations are desired, a perforating gun 850 is run into the cased or lined wellbore. The gun 850 is lowered through the gel cap 842 to the desired perforating interval that is filled with the porous liquid 844. The perforating gun 850 can then be shot inside the porous liquid 844.

Figure 10:
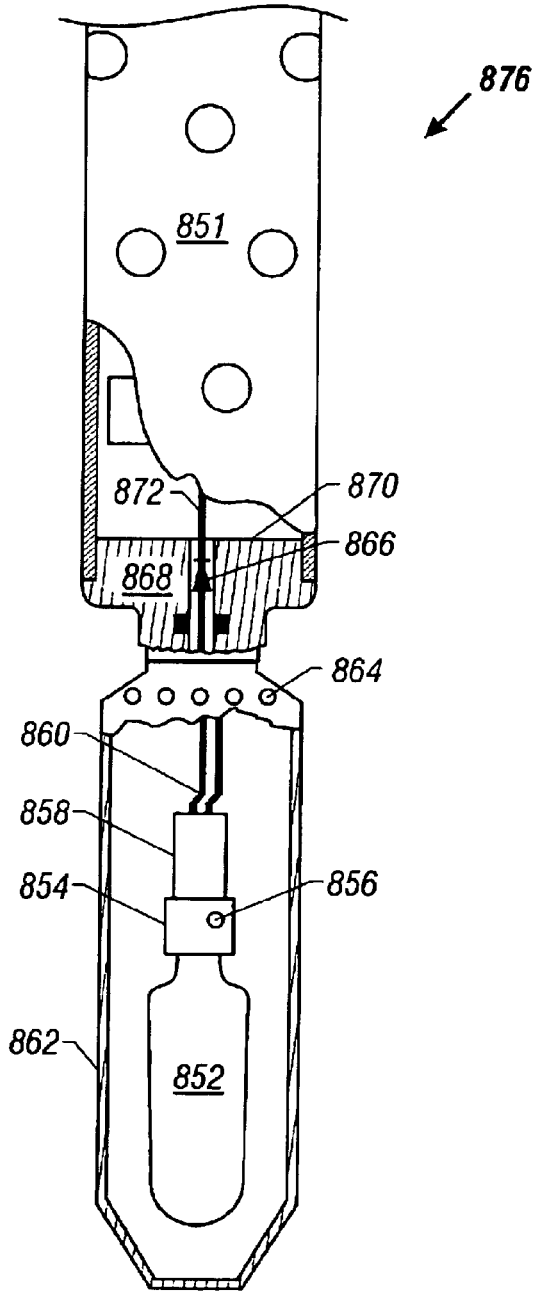
FIG. 10 illustrates a perforating string having a perforating gun and a bubble-delivering mechanism in accordance with yet another embodiment.

Referring to FIG. 10, another mechanism for providing a porous liquid around a gun 851 is illustrated. The mechanism includes a pressurized gas bottle 852 containing pressurized gas (e.g., nitrogen). An adapter 854 is connected to the upper end of the pressurized gas bottle 852 to maintain pressurization in the bottle 852. The adapter 856 is further connected to an electrically-activated vent system 858, which may include an electrically-activated puncture device to puncture a hole in the adapter 854, which causes gas to be released from the bottle 852 through release ports 856 of the adapter 854. The electrically-activated vent system is connected to wires 860. The assembly including the gas bottle 852, the adapter 854, and the vent system 858 is contained in an external housing 862. The upper end of the housing 862 has one or more ports 864 arranged around the circumference of the bottle 852 to enable communication between the inside of the housing 862 and the outside of the housing 862.

One of the wires 860 is connected to a diode switch 866 that is hermetically sealed inside the bore of an adapter 870 connected to the gun 850. In response to a signal received over a cable 872, the diode switch 868 communicates an electrical signal to activate the vent system 858.

In operation, a string including the gun 850 and the gas bottle assembly is lowered into the wellbore. When the string reaches a desired depth, an electrical signal is provided over the cable 872, which causes the vent system 858 to activate to release pressurized gas from the gas bottle 852 through the one or more vent ports 856 in the adapter 854. The pressurized gas flows into an inner chamber of the external housing 862. The gas is released through ports 864 into a region 876 around the gun 850. The bubbles formed in the liquid around the gun 850 allows for a reduction in interference as well as damage to downhole components (such as the casing).

In one embodiment, the bottle 852 contains a gas, which when released aerates the liquid around the gun 876. In another embodiment, the bottle 852 contains an aphron-based liquid under pressure. The aphron-based liquid is released from the bottle 852 and the outer housing 862 in similar fashion.

Other techniques and mechanisms of delivering porous liquids include conventional techniques and mechanisms used to deliver fluids downhole, such as those used to deliver gravel slurry, fracturing fluids, well treatment fluids, and so forth.

In alternative embodiments, other techniques of generating bubbles may be employed. For example, instead of a bottle containing gas, a propellant or explosive may be used to generate the gas. Alternatively, a refrigerant such as methyl chloride, carbon dioxide, or ammonia may also be used. Such refrigerants are liquid when the pressure rises above certain critical points, but remain in gaseous form when the pressure is under the critical points. The refrigerants may be carried into the wellbore under pressure in liquid form, such as inside the bottle 852. When the bottle 852 is opened up, the refrigerant is exposed to the wellbore pressure, which may be below the critical pressure. The refrigerant then turns into a gaseous state to provide the desired bubbles. As examples, the critical pressures for methyl chloride carbon dioxide, and ammonia are about 950 psi, 1050 psi, and 1600 psi, respectively.

In accordance with further embodiments, a shock barrier formed of a shock-impeding material may be used to reduce the effects of pre-shock caused by initiation of a detonation cord. In a first arrangement, the shock barrier may be positioned between the detonating cord and the outer wall of the shaped charge case. In another arrangement, the shock barrier isolates the shaped charge case from the explosive. In a third arrangement, a multi-layered barrier (or laminate barrier) may be used that includes multiple layers of alternating low impedance and high impedance materials to take advantage of reflections of shock at the interfaces between low impedance layers and high impedance layers, and vice versa. The shock impedance of a material is the product of its density and shock transfer speed. Low density and shock transfer speed implies a low shock impedance. A low shock impedance material has low shock transmissibility, while a high shock impedance material has high shock transmissibility. Further, increasing the time delay in which shock is transmitted decreases the shock transmissibility.

Figure 11:
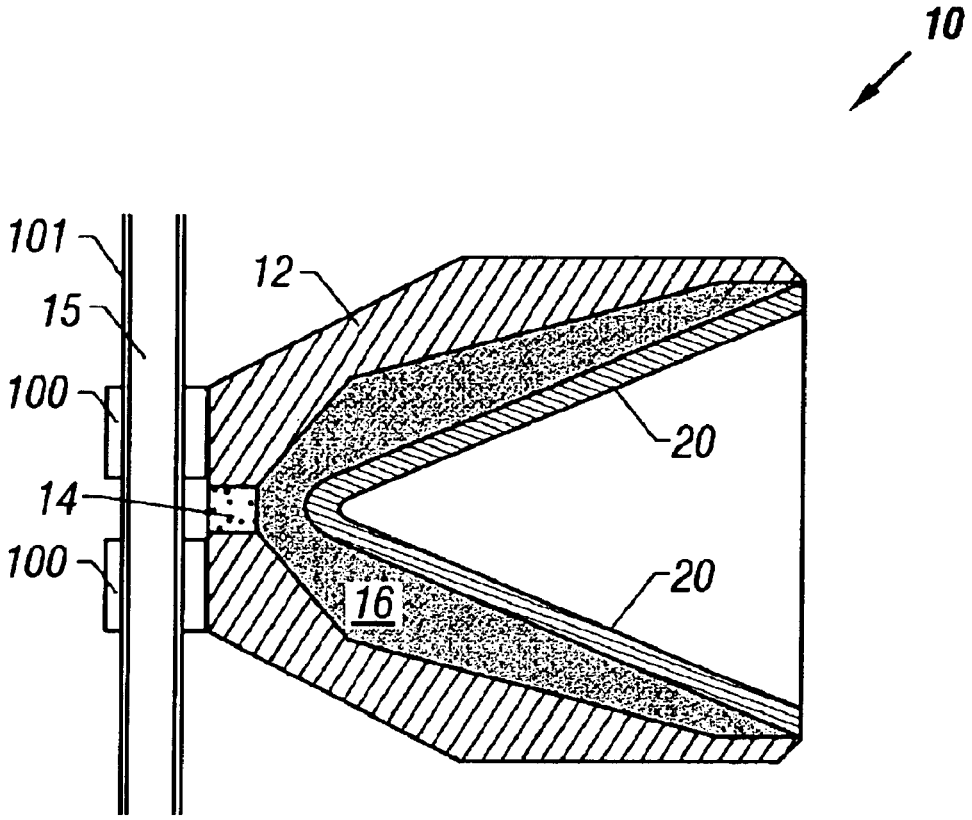
FIGS. 11, 12, and 13A–13B illustrate embodiments of shaped charge assemblies with shock barriers in accordance with a first type of arrangement.
Figure 12:
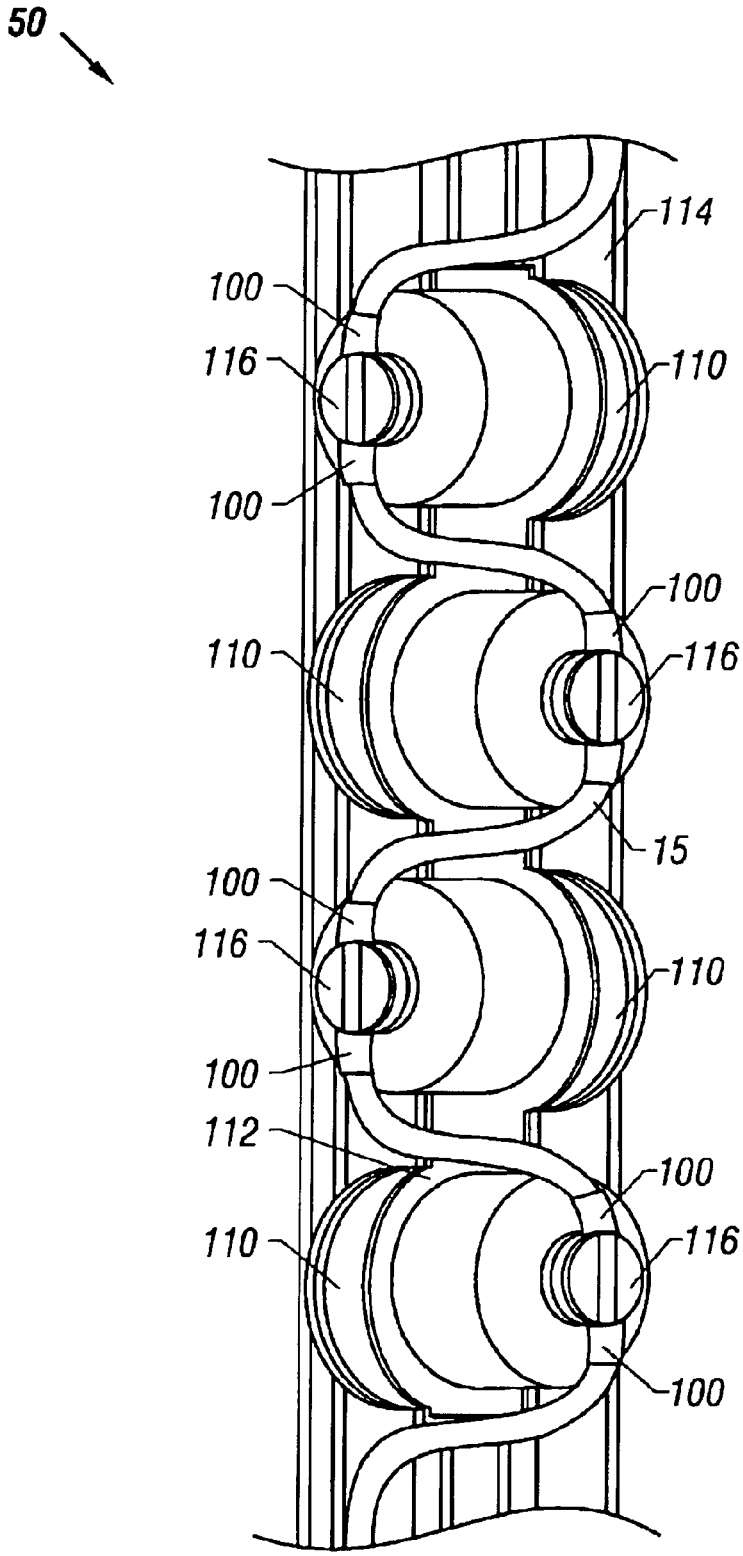
Figure 13A:
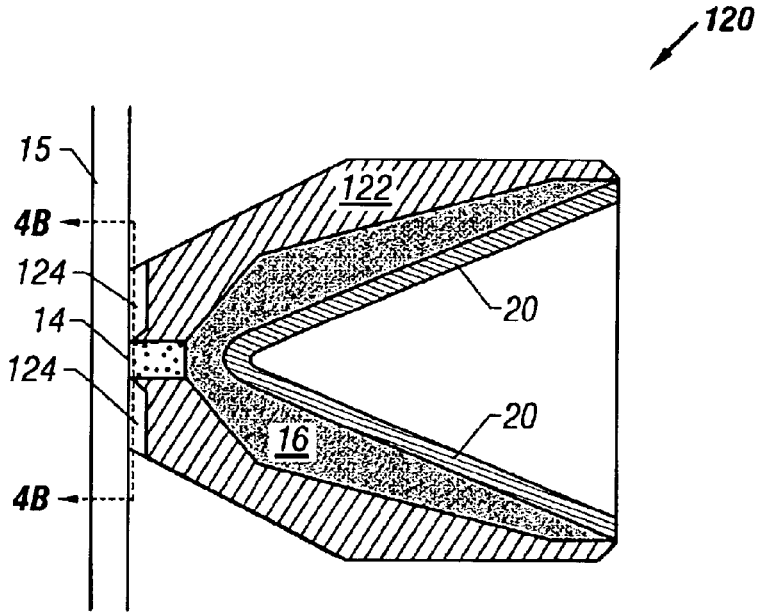
Figure 13B:
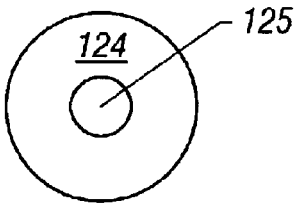

Referring to FIGS. 11, 12, and 13A–13B, example shock barriers according to the first arrangement are illustrated. Each of the charges in FIGS. 11 and 13A–13B may be capsule charges or non-capsule charges. FIG. 12 illustrates a portion of a strip perforating gun with capsule charges. A capsule charge includes an outer housing, which may include the outer case 12 as well as a cap (not shown) attached to the front portion of the outer case 12. A thinned portion (not shown) of the outer case 12 may also be formed behind the primer column 14 to contain the explosive elements within the capsule housing. A non-capsule charge may be arranged as illustrated in FIGS. 11 and 13A–13B.

In the FIG. 11 embodiment, the shock barrier may include generally tubular sleeves or boots 100 that are wrapped around the detonating cord 15 to isolate the detonating cord 15 from the rear surface of the outer case 12. The material of the shock-protection sleeves 100 may include any material having low shock transmissibility that provides better shock isolation, absorption, attenuation, and dampening than the outer case of the shaped charge.

The sleeve 100 may be a separate piece of material that is fitted over the detonating cord 15. Alternatively, the shock-protection sleeve 100 may be integrally formed with the outer jacket 101 of the detonating cord 15. In the latter embodiment, the shock-protection sleeve 100 is an extension of the outer jacket 101 to provide a thicker shock-protection layer.

The space behind the primer column 14 is not covered by the shock-protection sleeve so that the detonation wave energy of the detonating cord 15 can be transferred to the primer column 14 without interference to start an initiation. Thus, as a detonation wave travels down or up the detonating cord 15 (depending upon the arrangement of the shaped charge 10 with respect to the other shaped charges), one of the shock-protection sleeves 100 substantially reduces or eliminates the amount of pre-shock that is transferred to the outer case 12. With a substantially reduced or eliminated pre-shock, the initiation front from the primer column 14 into the explosive 16 can be more effective in collapsing the liner 20 for a perforating jet having improved penetration depth.

Referring to FIG. 12, the shock-protection sleeve 100 of FIG. 11 may be employed in a linear strip gun 50 in accordance with one embodiment. The linear strip gun 50 includes a linear strip carrier 114 on which a plurality of capsule charges 110 are attached in some phased arrangement (e.g., biphase arrangement, triphase arrangement, twisted arrangement, spiral arrangement, single phase arrangement, and so forth). The capsule charges may be maintained in the desired phased arrangement by a bracket 112. Each capsule charge 110 includes a detonating cord retainer 116 through which the detonating cord 15 is run. The shock-protection sleeves 100 are wrapped around portions of the detonating cord 15 that otherwise would make contact, or be in close proximity with, the rear surfaces of the capsule charges 110. In this embodiment, the detonating cord 15 is run in a rather tortuous path due to the ±45° twisted phased arrangement of the capsule charges 110. The sleeves 100 isolate the detonating cord 15 from the rear surface of each capsule charge 110 to offer shock protection caused by a detonation wave traveling in the detonating cord 15.

Experiments have shown that the shock-protection sleeves 100 are effective in improving the performance of the capsule charges 110 by increasing the penetration depth of the perforating jet produced by the capsule charges 110. Some experimental results have shown that the penetration depth improved from an average depth of approximately 19 inches (for some perforating guns that did not employ the protection sleeves 100) to an average penetration depth of approximately 28 inches for some other perforating guns that utilized the shock-protection sleeves 100. The performance gains may be different depending on the types of shaped charges used and the materials and thicknesses of the sleeves 100. In addition, the performance may be different for different phased arrangements of shaped charges. In addition, the penetration depths also depend on the materials used to form the liners of the shaped charges and the type of explosive used. Liners having non-conical shapes may also produce shallower penetration depths, but shock barriers in accordance with some embodiments may still be advantageously used with such shaped charges (e.g., big hole charges). In yet further embodiments, the shock-protection sleeves may be used in a perforating gun that includes non-capsule charges mounted within a tubing that seals the non-capsule charges from the well environment.

Additionally, according to another embodiment, instead of a sleeve, the entire thickness of the outer jacket 101 of the detonating cord 15 can be increased from conventional thicknesses to provide improved shock protection. The conventional thickness of the detonating cord jacket 101 varies depending on the type of material used for the jacket. In accordance with some embodiments, such thicknesses are increased to provide shock protection.

Referring to FIGS. 13A and 13B, a shaped charge 120 in accordance with another embodiment isolates the detonating cord 15 from an outer case 122 of the shaped charge 120 by using a layer 124 of a material that has low shock transmissibility attached to the rear surface of the outer case 122. As shown in FIG. 13B, the layer 124 may be in the shape of a disk (generally circular, rectangular, square, or having another shape) with a hole or more sensitive area (formed of a high shock transmissibility material, for example) 125 in the center for an energy communications path from the detonating cord to the primer column 14. The layer 124 may be deposited onto the back surface of the outer case 122, which is formed to receive the layer 124. In another embodiment, the layer 124 may be attached, such as by glue or by some other attachment mechanism, to the back surface of the outer case 122. The shock-protection layer 124 reduces the amount of pre-shock that is transferred from the detonating cord 15 to the explosive 16 through the outer case 122.

Figure 14A:
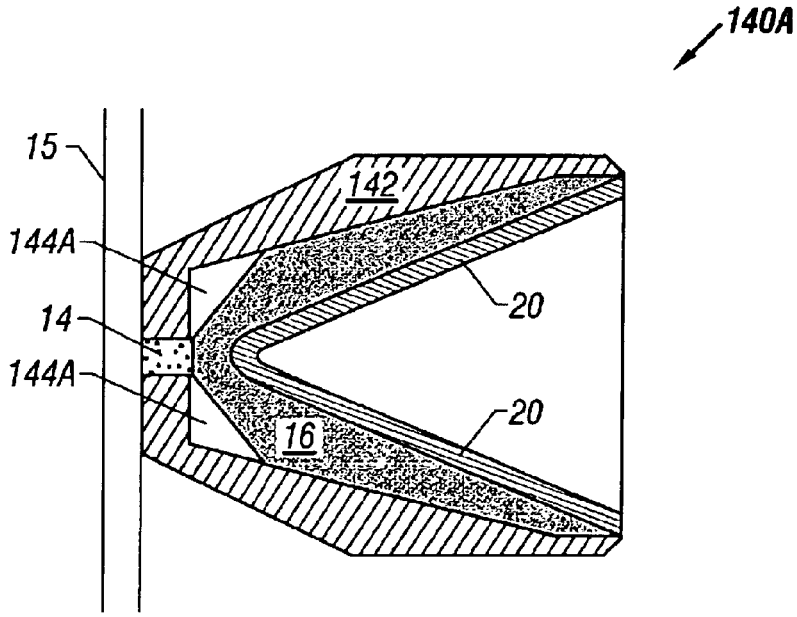
FIGS. 14A and 14B illustrate embodiments of a shaped charge assembly with a shock barrier in accordance with a second type of arrangement.

Referring to FIG. 14A, according to the second type of arrangement, an inner shock-protection layer 144A formed of a material having low shock transmissibility is positioned between the inner wall of the outer case 142 and a portion of the explosive 16 that is facing the rear of the outer case 142. In this embodiment, although pre-shock is transferred to the outer case 142, the layer 144A serves to attenuate and dampen the pre-shock wave so that a reduced amount of shock is transferred to the explosive 16.

Figure 14B:
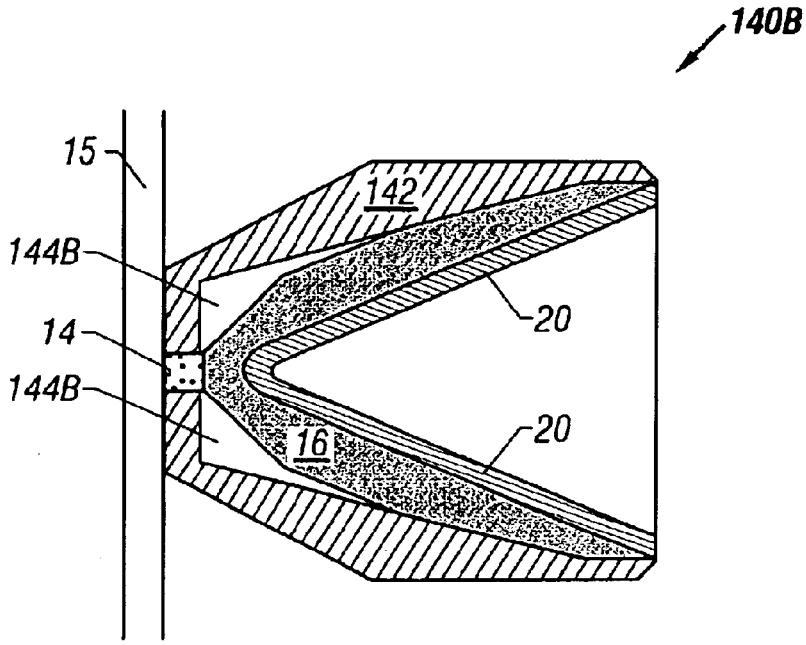

Referring to FIG. 14B, a shaped charge 140B includes an inner shock-protection layer 144B that is a variation of the layer 144A in FIG. 14A. The shock-protection layer 144B provides further protection for the explosive 16 by extending further to the front. By further extending the shock-protection as provided by the layer 144B, charge-to-charge interference can also be reduced since further isolation of the explosive is provided.

In accordance with the third type of arrangement, a shock barrier includes a multi-layer barrier, such as a laminate barrier. For example, referring to FIG. 15, a shaped charge 200 includes a laminate shock barrier 202 that includes three layers 204, 206, and 208. The layers 204 and 208 may be low shock impedance layers while the layer 206 is a high shock impedance layer. When a shock wave such as the pre-shock wave travels through the barrier 202, some portions of the shock wave are reflected by the interfaces between each of the layers (low impedance to high impedance and vice versa). In addition to the interfaces between layers 204, 206, and 208, the interface between the low impedance layer 208 and the high impedance case 210 may provide another reflection interface.

Figure 15:
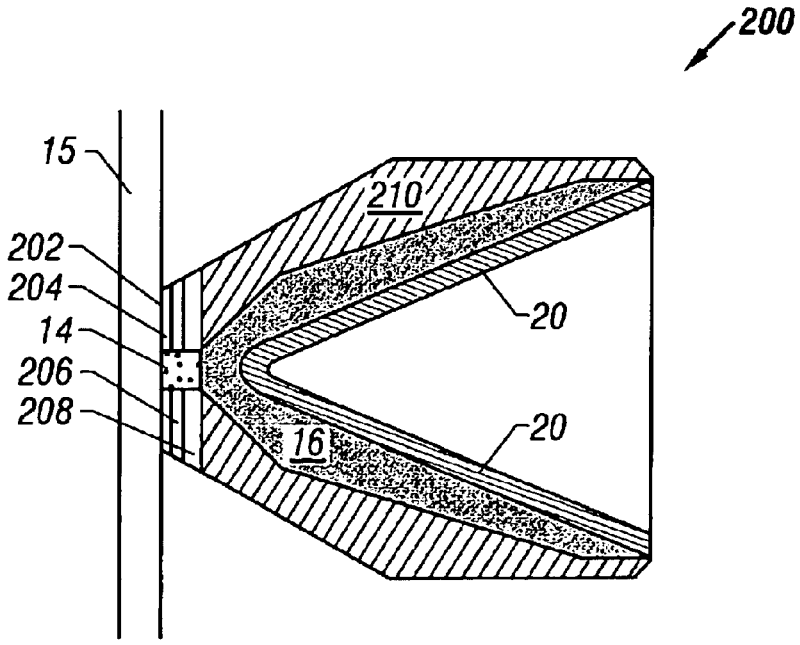
FIG. 15 illustrates an embodiment of a shaped charge assembly with a shock barrier in accordance with a third type of arrangement.

In variations of the FIG. 15 embodiment, an inner layer having a low shock transmissibility much like the layer 144 in FIG. 14A or 14B may be positioned between the inner wall of the case 210 and the explosive 16. Additionally, a sleeve may also be wrapped around portions of the detonating cord 15 proximal the shaped charge 200.

In other embodiments, shock-protection sleeves wrapped around portions of a detonating cord may be multi-layered, as may an inner low impedance layer positioned between the inner wall of the case 12 and the explosive 16. In yet another embodiment, the jacket or coating of the detonating cord may be multi-layered.

The multi-layered shock barrier may also include the following layers: the detonating cord jacket (a low impedance material); water; an outer disk (a low impedance material) attached to the shaped charge case; the outer case (a high impedance material); and an inner barrier layer (a low impedance material). More generally, the multi-layer shock barrier may include any combination of multiple low impedance and high impedance layers, such as the ones listed above in addition to laminate barriers.

The several embodiments of the shock barriers may be used with detonating cords of various types. The shock barriers allow use of the shaped charges with high-grain detonating cords since shock protection is provided. Additionally, some detonating cords may include lead or aluminum jackets instead of plastic jackets to enhance the energy output of the detonating cord to the primer column. Using shock barriers in accordance with some embodiments, energy output to the primer column can be enhanced while shock protection is afforded the rest of the shaped charges.

Some embodiments of the invention may provide one or more of the following advantages. Shock communication between a detonating cord and the shaped charge explosive is reduced to improve performance of the shaped charge. For all types of charges, reliability and performance of a shaped charge is greatly improved by reducing interference with the initiation train from a primer column to the shaped charge explosive. In addition, for deep-hole charges, the penetration depth can be greatly increased.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. An apparatus for use in a wellbore environment, comprising:

plural explosives;

a porous liquid; and an assembly to deliver the porous liquid in close proximity to the plural explosives to provide an impediment to shock wave propagation in the wellbore environment caused by detonation of the explosives, wherein the assembly comprises a sub containing one or more ports to deliver the porous liquid.

2. The apparatus of claim 1, wherein the porous liquid comprises aerated liquid.

3. The apparatus of claim 1, wherein the porous liquid comprises aphron-based liquid.

4. The apparatus of claim 1, wherein the porous liquid comprises a liquid containing shells filled with a compressible element selected from the group consisting of gas and vacuum.

5. The apparatus of claim 1, wherein the shells comprise microspheres.

6. The apparatus of claim 1, wherein the explosives comprise perforating shaped charges.

7. The apparatus of claim 1, further comprising a perforating gun having a strip, and wherein the explosives comprise capsule charges coupled to the strip.

8. The apparatus of claim 1, further comprising a tubing coupled to the sub, the tubing having an inner bore to deliver the porous liquid to the sub.

9. The apparatus of claim 1, wherein the assembly comprises a tubing having one or more ports to deliver the porous liquid.

10. An apparatus for use in a wellbore environment, comprising:

plural explosives;

an assembly to deliver a porous liquid in close proximity to the plural explosives to provide an impediment to shock wave propagation in the wellbore environment caused by detonation of the explosives, wherein the assembly comprises a sub containing one or more ports to deliver the porous liquid;

a tubing coupled to the sub, the tubing having an inner bore to deliver the porous liquid to the sub; and a cap moveable in the tubing inner bore to move the porous liquid.

11. The apparatus of claim 10, wherein the cap comprises a gel cap.

12. An apparatus for use in a wellbore environment, comprising:

plural explosives;

an assembly to deliver a porous liquid in close proximity to the plural explosives to provide an impediment to shock wave propagation in the wellbore environment caused by detonation of the explosives, wherein the assembly comprises a pressurized gas bottle to deliver gas to surrounding well liquid to provide the porous liquid; and a remotely-activated vent system coupled to the gas bottle to release gas from the gas bottle upon activation.

13. The apparatus of claim 12, further comprising an adapter connected to the gas bottle to maintain pressurization of the bottle, the vent system to puncture a hole in the adapter to release the gas from the gas bottle.

14. The apparatus of claim 12, wherein the vent system is electrically activated.

15. An apparatus for use in a wellbore environment, comprising:

plural explosives; and an assembly to deliver a porous liquid in close proximity to the plural explosives to provide an impediment to shock wave propagation in the wellbore environment caused by detonation of the explosives, wherein the assembly comprises a mechanism to generate gas to deliver to surrounding well liquid to provide the porous liquid, wherein the assembly further comprises a remotely-activated vent system to release gas generated by the mechanism.

16. The apparatus of claim 15, wherein the mechanism comprises a gas bottle.

17. The apparatus of claim 15, wherein the mechanism comprises at least one of a propellant and explosive activated prior to activation of the plural explosives.

18. The apparatus of claim 15, wherein the mechanism comprises a refrigerant.

19. The apparatus of claim 18, wherein the refrigerant comprises at least one of a methyl chloride, carbon dioxide, and ammonia.

20. An apparatus comprising:

an explosive;

a porous liquid proximal the explosive to impede shock caused by detonation of the explosive; and a sub containing one or more ports to deliver the porous liquid proximal the explosive.

21. The apparatus of claim 20, wherein the explosive comprises a shaped charge.

22. The apparatus of claim 20, further comprising at least another explosive, the porous liquid to reduce interference between the explosives.

23. The apparatus of claim 20, wherein the porous liquid contains a hollow filler material to achieve a predetermined porosity.

24. The apparatus of claim 23, wherein the hollow filler material contains a volume of gas.

25. The apparatus of claim 23, wherein the hollow filler material contains a volume of vacuum.

26. The apparatus of claim 20, wherein the porous liquid is in contact with the explosive.

27. A method for use in a wellbore, comprising:

positioning a tool including one or more explosives in the wellbore;

providing a porous liquid in close proximity to the one or more explosives for shock impediment; and delivering the porous liquid through a jetting sub having one or more ports.

28. The method of claim 27, wherein positioning the tool comprises positioning a perforating gun.

29. The method of claim 27, wherein providing the porous liquid comprises providing aerated liquid.

30. The method of claim 27, wherein providing the porous liquid comprises providing aphron-based liquid.

31. The method of claim 27, wherein providing the porous liquid comprises providing a liquid containing shells each filled with a compressible element selected from the group consisting of gas and vacuum.

32. A method for use in a wellbore, comprising:

positioning a tool including one or more explosives in the wellbore;

providing a porous liquid in close proximity to the one or more explosives for shock impediment;

delivering the porous liquid through an inner bore of a tubing; and moving a cap in the inner bore of the tubing to deliver the porous liquid.

33. A method for use in a wellbore, comprising:

positioning a tool including one or more explosives in the wellbore;

providing a porous liquid in close proximity to the one or more explosives for shock impediment; and releasing gas from a remotely-actuatable vent mechanism into surrounding well liquid to provide the porous liquid.

34. The method of claim 33, wherein releasing the gas comprises releasing gas from a gas bottle.

35. The method of claim 33, wherein releasing the gas comprises activating at least one of a propellant and explosive in the mechanism.

36. The method of claim 33, wherein releasing the gas comprises releasing the gas from a refrigerant.

37. A method for use in a wellbore, comprising:

positioning a tool including one or more explosives in the wellbore;

providing a porous liquid in close proximity to the one or more explosives for shock impediment; and launching a wiper plug into a casing, with the porous liquid provided above the wiper plug, to deliver the porous liquid.

38. The method of claim 37, wherein launching the wiper plug is performed during a cementing operation.

39. The method of claim 38, further comprising providing a cap above the porous liquid such that the porous liquid is between the cap and wiper plug.

40. A method for use in a wellbore, comprising;

positioning a tool in the wellbore; and providing aphron-based liquid proximate the tool, wherein positioning the tool comprises positioning a tool containing an explosive; and wherein positioning the tool comprises positioning a perforating tool.

41. The method of claim 40, wherein providing the aphron-based liquid comprises providing liquid containing shells each encapsulating a liquid or gas.

42. The method of claim 41, wherein providing the liquid containing the shells comprises providing the liquid containing thin acqueous shells.

43. The method of claim 42, wherein providing the liquid containing the thin acqueous shells comprises providing shells containing surfactant molecules positioned to provide an effective barrier against coaslence with adjacent shells.

44. The method of claim 40, further comprising firing the perforating tool.

45. An apparatus comprising:

a tool; and an aphron-based liquid surrounding the tool, wherein the tool comprises an explosive; and wherein the tool comprises a perforating gun.

46. The apparatus of claim 45, further comprising a mechanism to deliver the aphron-based liquid to a region surrounding the tool.

47. The apparatus of claim 45, wherein the aphron-based liquid contains shells each encapsulating a liquid or gas.

48. The apparatus of claim 47, wherein each shell comprises a thin acqueous shell.

49. An apparatus comprising:

a tool containing an explosive;

an aphron-based liquid; and a sub containing one or more ports to deliver the aphron-based liquid to a region surrounding the tool.

50. The apparatus of claim 49, wherein the tool comprises a perforating tool.

* * * * *